US007240469B2

(12) United States Patent
Ghini et al.

(10) Patent No.: US 7,240,469 B2
(45) Date of Patent: Jul. 10, 2007

(54) CIGARETTE PACKING MACHINE FOR PRODUCING RIGID HINGED-LID PACKETS

(75) Inventors: Marco Ghini, Monte San Pietro (IT); Roberto Polloni, Modigliana (IT); Stefano Negrini, Calderara Di Reno (IT)

(73) Assignee: G.D Societa' per Azioni, Bologna (IT)

( * ) Notice: Subject to any disclaimer, the term of this patent is extended or adjusted under 35 U.S.C. 154(b) by 0 days.

(21) Appl. No.: 11/401,433

(22) Filed: Apr. 10, 2006

(65) Prior Publication Data

US 2006/0254212 A1 Nov. 16, 2006

(30) Foreign Application Priority Data

Apr. 13, 2005 (IT) ..... BO2005A0235

(51) Int. Cl.
*B65B 11/32* (2006.01)
*B65B 19/22* (2006.01)

(52) U.S. Cl. ..... 53/466; 53/234

(58) Field of Classification Search ..... 53/234
See application file for complete search history.

(56) References Cited

U.S. PATENT DOCUMENTS 4,095,396 A * 6/1978 Seragnoli ..... 53/234
4,144,695 A * 3/1979 Seragnoli ..... 53/234
5,163,268 A * 11/1992 Vaccari et al. ..... 53/397
5,216,869 A 6/1993 Boldrini et al.
5,755,080 A * 5/1998 Draghetti et al. ..... 53/466
5,906,087 A * 5/1999 Boldrini ..... 53/462
6,694,708 B2 * 2/2004 Brizzi et al. ..... 53/462
6,715,605 B1 4/2004 Manservigi et al.
6,854,243 B2 * 2/2005 Sendo et al. ..... 53/234

FOREIGN PATENT DOCUMENTS

EP 1 321 363 6/2003
WO 2005/087595 9/2005

* cited by examiner

*Primary Examiner*—John Sipos
(74) *Attorney, Agent, or Firm*—Ladas & Parry LLP

(57) ABSTRACT

A cigarette packing machine for producing rigid, hinged-lid, short-hinge packets of cigarettes; the packing machine has a fourth packing wheel which receives wrapped groups of cigarettes from a third transfer wheel at a third transfer station, receives collars from a first feed line at an input station upstream from the third transfer station, and folds each collar into a tube about a respective wrapped group of cigarettes; the packing machine also has a fifth packing wheel which, at a fourth transfer station, receives each wrapped group of cigarettes and the respective collar together with a respective blank supplied by a second feed line, folds the blank about the wrapped group of cigarettes to form an outer package, and releases the packets of cigarettes at a fifth transfer station.

16 Claims, 4 Drawing Sheets

CIGARETTE PACKING MACHINE FOR PRODUCING RIGID HINGED-LID PACKETS

The present invention relates to a cigarette packing machine for producing rigid, hinged-lid packets.

Rigid, hinged-lid packets of cigarettes are currently the most widely marketed, by being easy to produce, easy and practical to use, and by providing good protection of the cigarettes inside.

BACKGROUND OF THE INVENTION

A rigid, hinged-lid packet of cigarettes comprises a group of cigarettes wrapped in a sheet of foil; and a rigid outer package housing the group of cigarettes. The outer package comprises a cup-shaped container housing the group of cigarettes and having an open top end; and a cup-shaped lid hinged to the container along a hinge to rotate, with respect to the container, between an open position and a closed position respectively opening and closing the open end. A collar is normally folded and fitted inside the container to project partly outwards of the open end and engage a corresponding inner surface of the lid when the lid is in the closed position.

The outer package is parallelepiped-shaped, and is bounded by a horizontal top wall, a horizontal bottom wall opposite and parallel to the top wall, a vertical front wall, a vertical rear wall opposite and parallel to the front wall, and two opposite, parallel, vertical lateral walls; the lid hinge is horizontal and located on the rear wall; and the collar is U-shaped and contacts the inner surface of the front wall and lateral walls.

In almost all currently marketed rigid cigarette packets, the front and rear walls are larger than the lateral walls. Rigid, so-called "short-hinge" cigarette packets have also been proposed, however, in which the front and rear walls are smaller than the lateral walls, and in which the collar is preferably tubular and therefore contacts the inner surface of both the front and lateral walls and the rear wall.

A cigarette packing machine normally comprises a packing assembly, which receives a succession of foil-wrapped groups of cigarettes, and folds a blank about each group of cigarettes to form a rigid outer package. More specifically, a cardboard blank is fed, together with a foil-wrapped group of cigarettes, into a pocket on a packing wheel, which rotates through a number of folding stations where the blank is gradually folded about the group of cigarettes to form the rigid outer package.

Packing machines for producing packets of the above type are known and employed throughout the tobacco industry. Known currently marketed packing machines, however, are designed to produce standard rigid cigarette packets, in which the front and rear walls are larger than the lateral walls, but not rigid, short-hinge cigarette packets, in which the front and rear walls are smaller than the lateral walls, and which feature a tubular collar.

At present, rigid, short-hinge cigarette packets are produced on special packing machines which differ considerably from the standard packing machines described above. In particular, the special packing machines employ flattened tubular blanks, which are "opened" along a packing line to receive respective axially-fed groups of cigarettes. Though producing good-quality packets of cigarettes, special machines of the above type are expensive to produce, have a low output rate, and, above all, employ flattened tubular blanks which are much more expensive and difficult to process than ordinary flat blanks.

SUMMARY OF THE INVENTION

It is an object of the present invention to provide a cigarette packing machine for producing rigid, hinged-lid, short-hinge packets, and which at the same time is cheap and easy to implement.

According to the present invention, there is provided a cigarette packing machine for producing rigid, hinged-lid packets, as claimed in the attached Claims.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
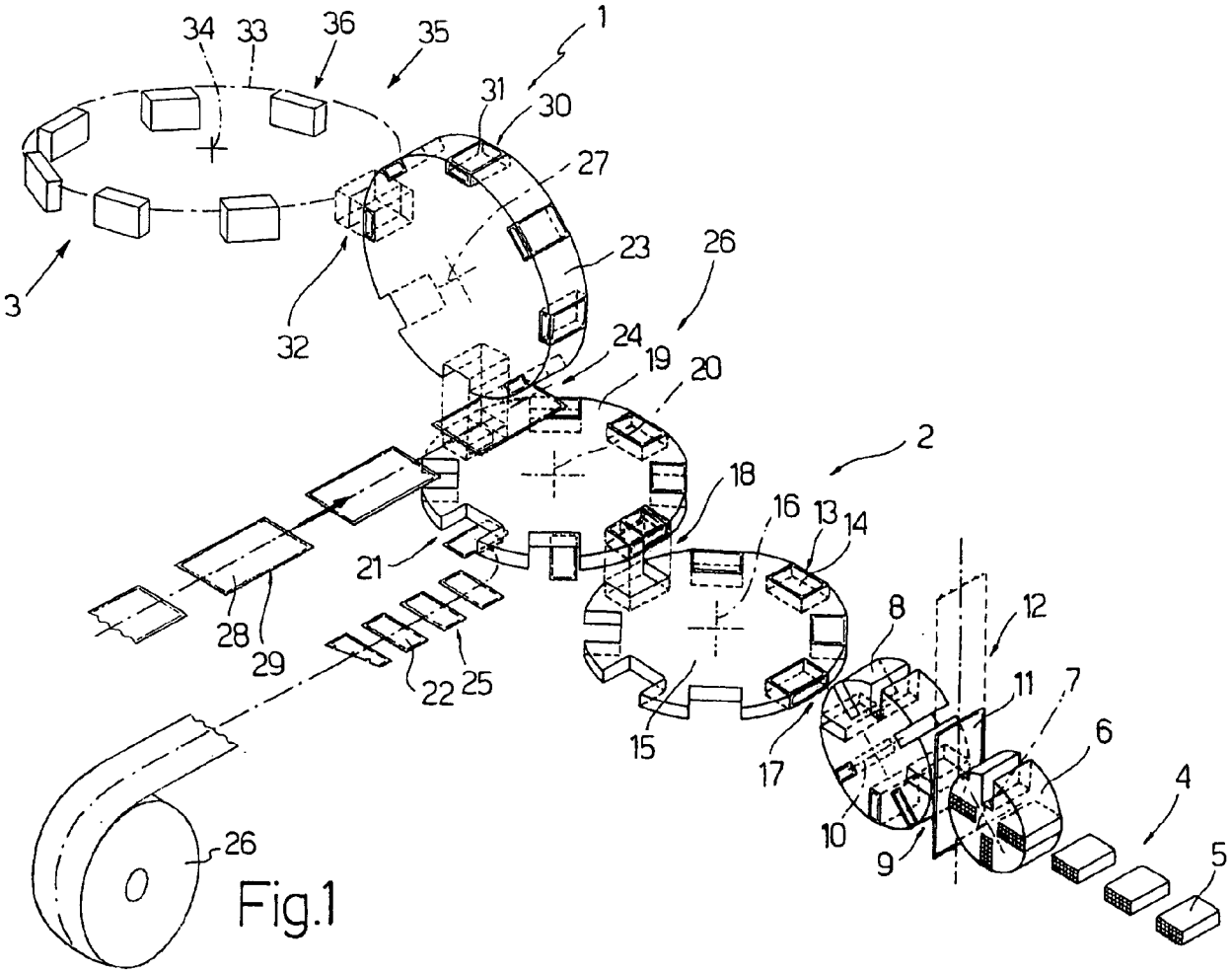
FIG. 1 shows a schematic view in perspective, with parts removed for clarity, of a preferred embodiment of a cigarette packing machine in accordance with the present invention.

Number 1 in FIG. 1 indicates as a whole a cigarette packing machine comprising a packing portion 2 and an output portion 3.

Packing portion 2 comprises a known line 4 (shown only partly) for forming groups 5 of cigarettes; and a first transfer wheel 6 rotating in steps about a respective horizontal axis of rotation 7 to receive groups 5 successively, and transfer groups 5 to a second packing wheel 8 at a transfer station 9. Second packing wheel 8 is mounted to rotate in steps about a respective axis of rotation 10 parallel to axis of rotation 7, and receives groups 5 of cigarettes successively, each together with a respective sheet 11 of foil packing material supplied to transfer station 9 by a feed line 12. Second packing wheel 8 folds each sheet 11 of packing material about respective group 5 of cigarettes to form a wrapped group 13, in which group 5 of cigarettes is enclosed in a so-called inner wrapping 14.

Packing portion 2 also comprises a third transfer wheel 15 rotating in steps about a respective vertical axis of rotation 16 crosswise to axis of rotation 7, and which receives wrapped groups 13 successively from second packing wheel 8 at a transfer station 17. At a transfer station 18, third transfer wheel 15 feeds wrapped groups 13 to a fourth packing wheel 19 rotating in steps about a respective axis of rotation 20, parallel to axis of rotation 16, and structurally identical to third transfer wheel 15. On the periphery of both third transfer wheel 15 and fourth packing wheel 19, each rectangular parallelepiped-shaped wrapped group 13 is positioned on edge, i.e. with a minor lateral surface facing outwards, and with its longitudinal axis (always parallel to the cigarette axes) crosswise to axes of rotation 16 and 20 and tangential with respect to the periphery of relative transfer wheel 15 and packing wheel 19. Fourth packing wheel 19 and third transfer wheel 15 overlap at transfer station 18, and wrapped groups 13 are transferred from third transfer wheel 15 to fourth packing wheel 19 in a vertical movement parallel to axes of rotation 16 and 20.

At an input station 21 upstream from transfer station 18, fourth packing wheel 19 successively receives creased cardboard collars 22, each of which is folded about a respective wrapped group 13 before being transferred, together with respective wrapped group 13, to a fifth packing wheel 23 at a transfer station 24. Collars 22 are fed to input station 21 by a known feed line 25. More specifically, collars 22 are formed in known manner from a continuous strip of cardboard unwound off a reel 26.

Fifth packing wheel 23 is an output wheel of packing portion 2, is mounted to rotate in steps about a respective horizontal axis of rotation 27 parallel to axis of rotation 7, receives each wrapped group 13 and respective collar 22 together with a respective blank 28 fed to transfer station 24 by a feed line 29, and folds each blank 28 about respective wrapped group 13 to form a packet 30, in which wrapped group 13 is housed inside an outer package 31 formed by folding blank 28.

Packets 30 are fed successively from fifth packing wheel 23 to an input of output portion 3 at a transfer station 32. More specifically, each packet 30 reaching transfer station 32 is positioned flat on the periphery of fifth packing wheel 23, i.e. with a major lateral surface of relative wrapped group 13 facing outwards, and with the longitudinal axis of relative wrapped group 13 (parallel to the relative cigarettes) parallel to axis of rotation 27 of fifth packing wheel 23.

Output portion 3 comprises a sixth transfer wheel 33 rotating in steps about a respective horizontal axis of rotation 34 crosswise to axis of rotation 27 of fifth packing wheel 23. At transfer station 32, sixth transfer wheel 33 receives packets 30 successively from fifth packing wheel 23, and transfers packets 30 to a drying area 35 (shown schematically) at a transfer station 36. Drying area 35 constitutes an output of packing machine 1, and feeds packets 30 to a follow-up cellophaning machine (not shown) which applies an overwrapping of transparent plastic material about each packet 30.

Figure 2:
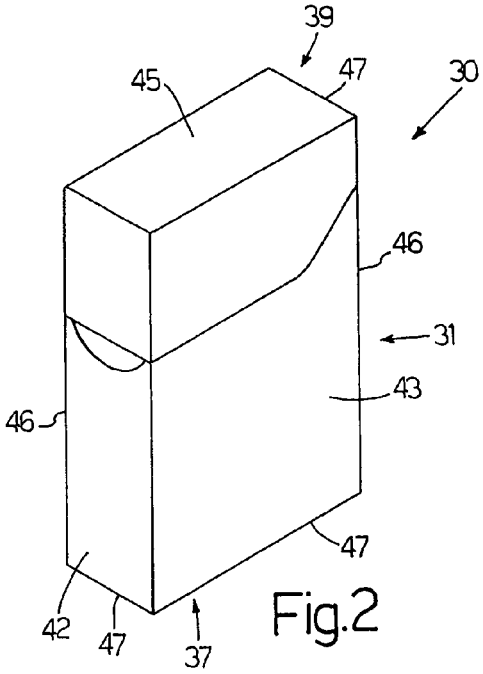
FIG. 2 shows a view in perspective of a rigid packet of cigarettes produced on the FIG. 1 packing machine and in a closed configuration.
Figure 3:
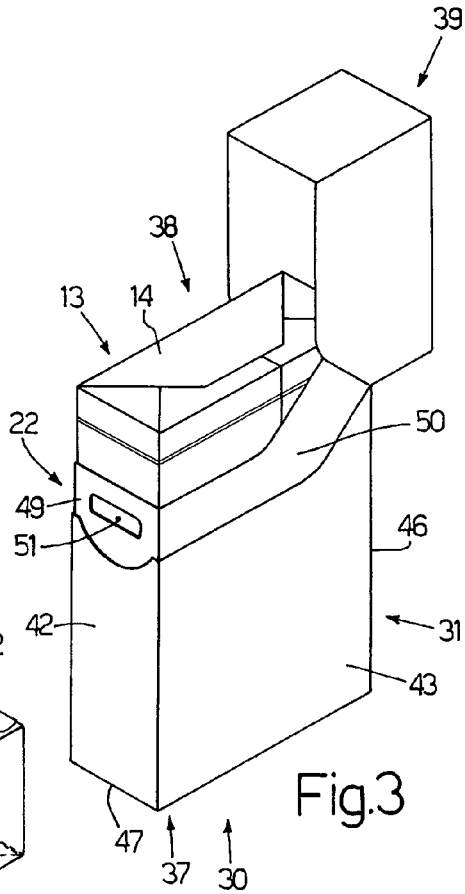
FIG. 3 shows a view in perspective of the FIG. 2 rigid packet of cigarettes in an open configuration.
Figure 4:
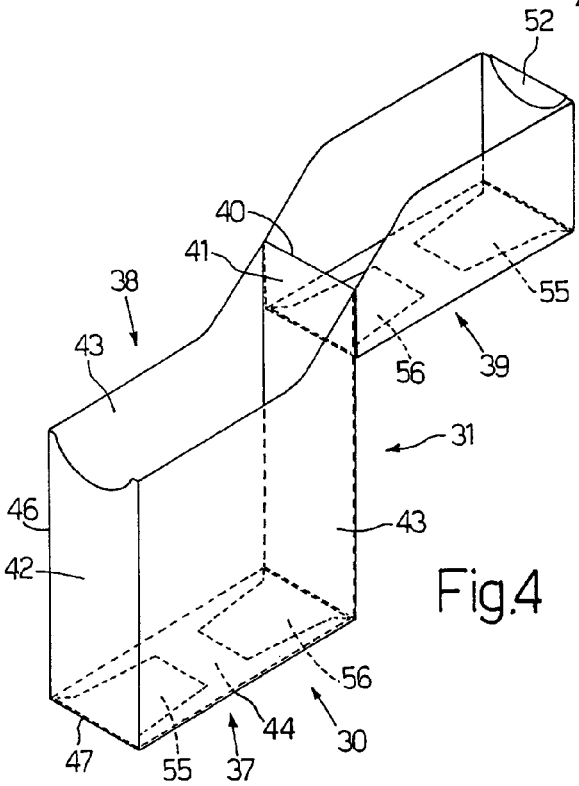
FIG. 4 shows a view in perspective of the FIG. 2 rigid packet of cigarettes in an open configuration and with the group of cigarettes and the collar removed for the sake of clarity.

FIGS. 2, 3 and 4 show a packet 30 produced on packing machine 1 as described above. More specifically, packet 30 is a "short-hinge" type, the outer package 31 of which comprises a cup-shaped container 37 having an open top end 38 (FIGS. 3 and 4); and a cup-shaped lid 39 hinged to container 37 along a hinge 40 (FIG. 4) to rotate, with respect to container 37, between an open position (FIGS. 3 and 4) and a closed position (FIG. 2) respectively opening and closing open top end 38. The bottom edge of lid 39 (and therefore the top edge of container 37, which is the same shape as the bottom edge of lid 39) is preferably S-shaped, so that lid 39 is shorter in height close to hinge 40.

When lid 39 is in the closed position, outer package 31 is parallelepiped-shaped, and comprises a vertical rear wall 41; a vertical front wall 42 opposite and parallel to rear wall 41 (shown in FIG. 4); two opposite parallel vertical lateral walls 43 (only one shown in FIGS. 2 and 3); a horizontal bottom wall 44 (FIG. 4); and a horizontal top wall 45 (FIG. 2) opposite and parallel to bottom wall 44. Front wall 42 and rear wall 41 are smaller than lateral walls 43; and hinge 40 of lid 39 is horizontal and located on rear wall 41.

Outer package 31 has four longitudinal edges 46 defined between lateral walls 43 and front and rear walls 42 and 41; and eight transverse edges 47 defined between top and bottom walls 45 and 44 and lateral walls 43, front wall 42, and rear wall 41. In the FIG. 2-4 embodiment, longitudinal edges 46 and transverse edges 47 are all square. In different embodiments not shown, at least some of longitudinal edges 46 or at least some of transverse edges 47 are rounded or bevelled. For example, longitudinal edges 46 may all be non-square, rounded or bevelled edges, or some transverse edges 47 may be non-square, rounded or bevelled edges (as in the packet of cigarettes described in Patent Application EP-A1-0764595); or some longitudinal edges 46 and some transverse edges 47 may be non-square, rounded or bevelled edges, so as to have both non-square, rounded or bevelled longitudinal edges 46 and transverse edges 47.

In a different embodiment not shown, packet 30 may resemble the packet of cigarettes described in Patent Application EP-A1-1066205; in which case, rear wall 41 and front wall 42 are outwardly convex, and each have a flat central portion, and two curved creased lateral bands connecting the flat central portion to lateral walls 43 at respective sharp, non-square longitudinal edges 46.

Figure 6:
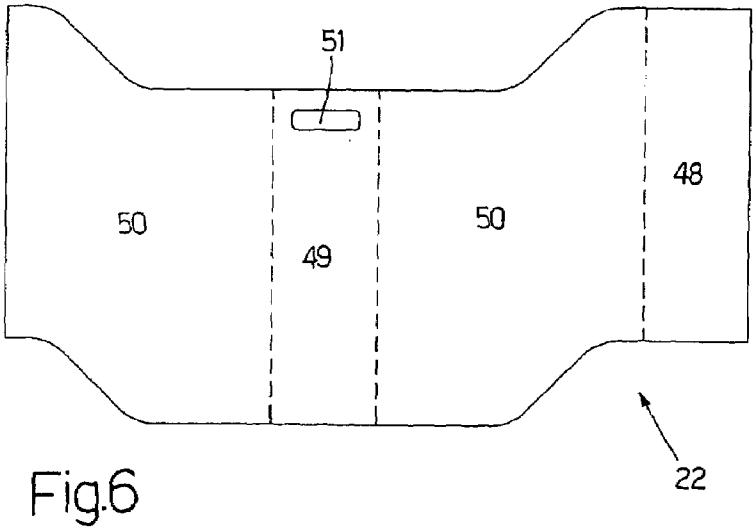
FIG. 6 shows a plan view of a collar of the rigid packet of cigarettes in FIGS. 2-4.

Collar 22 is folded into a tube about wrapped group 13, and is positioned inside outer package 31 so as to project partly from open top end 38 of container 37 and engage an inner surface of lid 39 when lid 39 is in the closed position. As shown in FIG. 6, collar 22 comprises a rear wall 48, which is positioned contacting an inner surface of rear wall 41 of outer package 31; a front wall 49, which is positioned contacting an inner surface of front wall 42 of outer package 31; and two lateral walls 50, which are positioned contacting respective inner surfaces of lateral walls 43 of outer package 31.

The purpose of collar 22 is to keep lid 39 closed by requiring the application of a certain amount of force to open lid 39. For which purpose, front wall 49 of collar 22 has a horizontal slit 51 (FIG. 3), and the bottom edge of front wall 42 of lid 39 has a tab 52 (FIG. 4) projecting inwards of lid 39, and which, when lid 39 is in the closed position, releasably engages slit 51 to hold lid 39 in the closed position.

In a different embodiment not shown, collar 22 has no rear wall 48, and is folded into a U about wrapped group 13.

Figure 5:
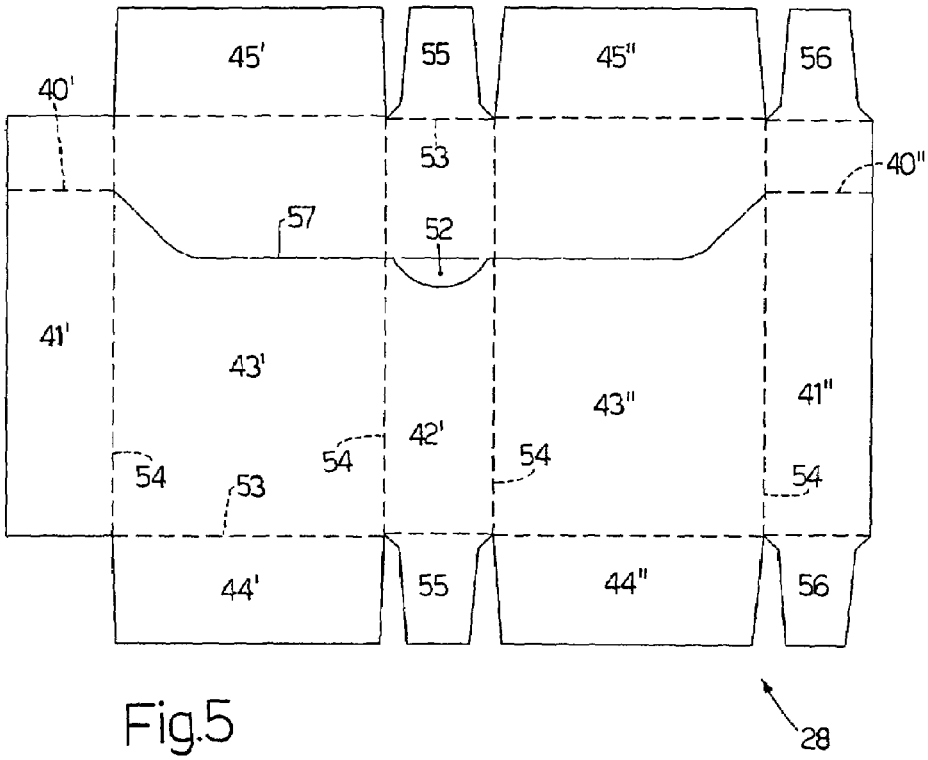
FIG. 5 shows a plan view of a blank from which to form an outer package of the rigid packet of cigarettes in FIGS. 2-4.

As stated, outer package 31 of each rigid packet 30 of cigarettes is formed by folding a blank 28 as shown in the unfolded configuration in FIG. 5, in which the parts of blank 28 are indicated, where possible, using the same reference numbers, with superscripts, as for the corresponding parts of outer package 31.

Blank 28 has two transverse fold lines 53, and a number of longitudinal fold lines 54 defining, between the two transverse fold lines 53, a panel 41' forming an inner portion of rear wall 41; a panel 43' forming a first lateral wall 43; a panel 42' forming front wall 42; a panel 43" forming a second lateral wall 43; and a panel 41" forming an outer portion of rear wall 41.

Panel 43' has two tabs 44' and 45', which are located at opposite ends of panel 43', are separated from panel 43' by the two transverse fold lines 53, and form outer portions of bottom wall 44 and top wall 45 respectively. Panel 43" has two tabs 44" and 45", which are located at opposite ends of panel 43", are separated from panel 43" by the two transverse fold lines 53, and form inner portions of bottom wall 44 and top wall 45 respectively. Panel 42' and panel 41" each have two tabs 55, 56, which are located at opposite ends of panel 42', 41", are separated from panel 42', 41" by the two transverse fold lines 53, and are glued to the inside of bottom wall 44 and top wall 45.

Panel 41' and panel 41" have a fold line 40' and a fold line 40" respectively. When panel 41' is superimposed on and glued to panel 41" to form rear wall 41, fold lines 40' and 40" are superimposed to define hinge 40 of lid 39. A cut line 57 extends from fold line 40' to fold line 40" and, substantially parallel to transverse fold lines 53, across panels 43', 42' and 43" to separate the part of blank 28 forming container 37 from the part forming hinged lid 39. On panel 42', cut line 57 is preferably shaped to define tab 52 on one side, and, on the other, a cavity complementary in shape to tab 52.

Figure 7:
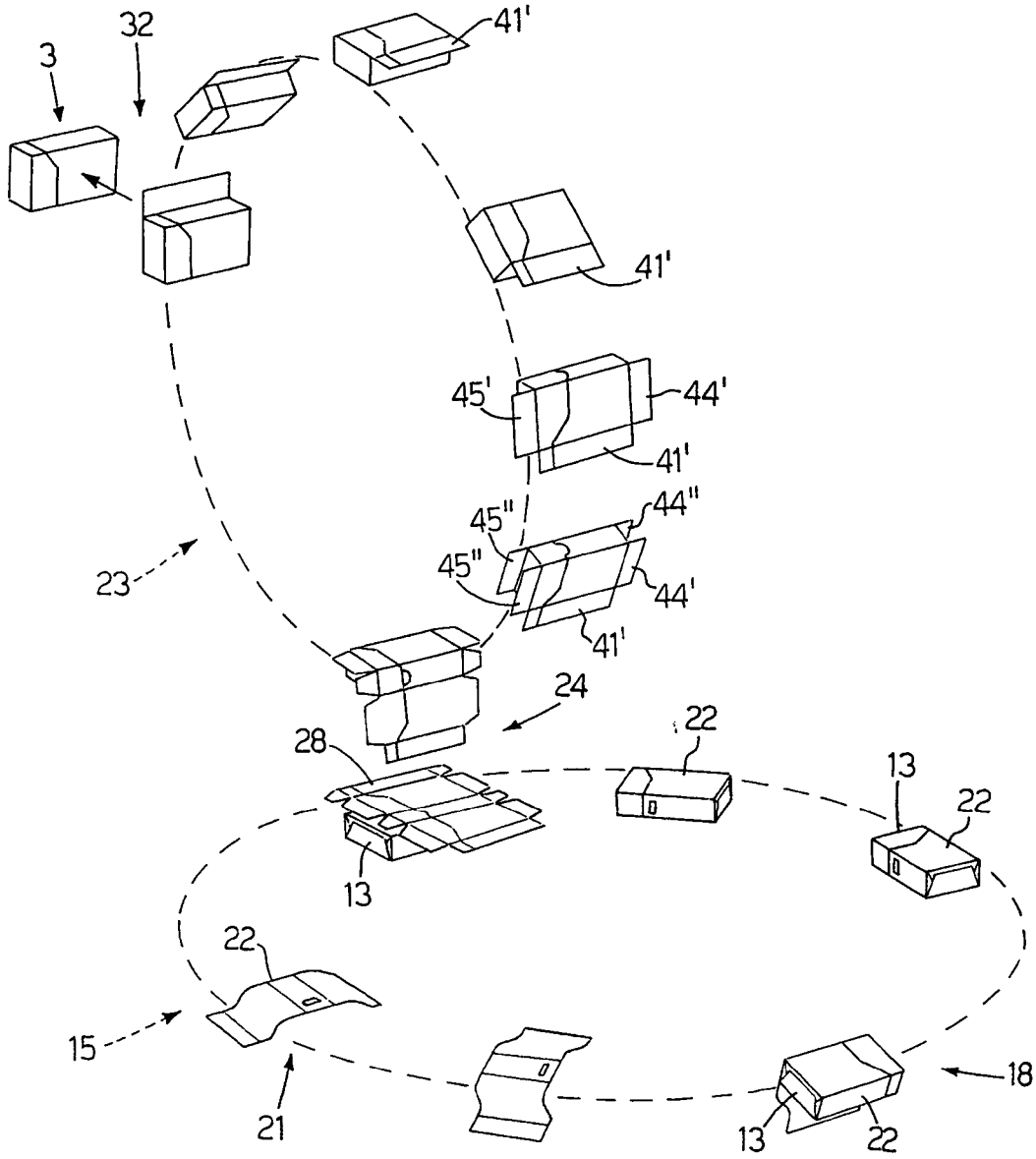
FIG. 7 shows, schematically, the folding sequence performed by the FIG. 1 packing machine to form an outer package of the rigid packet of cigarettes in FIGS. 2-4.

The folding sequence performed by packing machine 1 in FIG. 1 to form outer package 31 of the rigid packet 30 of cigarettes in FIG. 2 will now be described with particular reference to FIG. 7. For the sake of simplicity, the folding operations performed by packing machine 1 will be described with reference to one wrapped group 13 of cigarettes fed to fourth packing wheel 19 at transfer station 18.

At input station 21 upstream from transfer station 18, fourth packing wheel 19 is supplied by feed line 25 with a creased cardboard collar 22, which is supplied flat (i.e. in an unfolded configuration) and is folded into a tube about wrapped group 13 before being transferred, together with wrapped group 13, to fifth packing wheel 23 at transfer station 24.

Collar 22 is supplied flat to fourth packing wheel 19 at input station 21, and remains flat up to transfer station 18, where wrapped group 13 is inserted inside a seat on fourth packing wheel 19 together with collar 22, which folds into a U about wrapped group 13. More specifically, at transfer station 18, collar 22 is folded into a U about wrapped group 13 by folding rear wall 48 and front wall 49 squarely with respect to one lateral wall 50. As wrapped group 13 is fed from transfer station 18 to transfer station 24, fixed folding devices (not shown) fold the other lateral wall 50 of collar 22 ninety degrees with respect to front wall 49 and onto wrapped group 13 to complete the folding of collar 22 into a tube about wrapped group 13.

In a different embodiment not shown, collar 22 is fed flat to fourth packing wheel 19 at input station 21, and is immediately folded into a U by insertion of collar 22 inside a seat on fourth packing wheel 19.

It is important to note that, along feed line 25 and close to input station 21, collar 22 is gummed (i.e. is spotted with glue) to adhere permanently to wrapped group 13. Alternatively, collar 22 may be gummed between input station 21 and transfer station 18.

Fifth packing wheel 23 receives wrapped group 13 and collar 22 together with a flat blank 28 supplied, with its outer surface facing upwards, by feed line 29 to transfer station 24. At transfer station 24, wrapped group 13 is inserted inside a seat on fifth packing wheel 23 together with blank 28, which folds into a U about wrapped group 13. More specifically, at transfer station 24, blank 28 is folded into a U about wrapped group 13 by folding panel 41" squarely with respect to panel 43", and folding panel 42' squarely with respect to panel 43". Immediately downstream from transfer station 24, fixed folding devices (not shown) fold panel 43' squarely with respect to panel 42' and onto wrapped group 13 to complete the folding of blank 28 into a tube about wrapped group 13. At this point, movable folding fingers (not shown) fold both tabs 55 squarely with respect to panels 41' and 42' and onto wrapped group 13, and fixed folding devices (not shown) fold both tabs 56 squarely with respect to panels 41' and 42' and onto wrapped group 13.

Next, fixed folding devices (not shown) fold tabs 44" and 45" squarely with respect to panel 43" and onto wrapped group 13 and the previously folded tabs 55 and 56; and, finally, fixed folding devices (not shown) fold tabs 44' and 45' squarely with respect to panel 43' and onto wrapped group 13 and the previously folded tabs 44" and 45".

By the time it reaches transfer station 32, blank 28 is almost completely folded about wrapped group 13, and it only remains to fold panel 41' onto wrapped group 13 and the previously folded panel 41"; which is done by a fixed folding device (not shown) at transfer station 32, as wrapped group 13 is expelled from the seat on fifth packing wheel 23 into a seat on sixth transfer wheel 33.

It is important to note that, along feed line 29 and close to transfer station 24, blank 28 is gummed (i.e. spotted with glue) to stabilize outer package 31. In a preferred embodiment, the inner surfaces of panel 41" and tabs 44" and 45" are gummed; and parts of the inner surfaces of panels 43', 42' and 43" corresponding to collar 22 are also gummed to permanently glue collar 22 and outer package 31 to each other.

Packing machine 1 as described above produces rigid, short-hinge packets of cigarettes, has a high output rate (up to 500-600 packets a minute), and is cheap and easy to produce, by closely resembling a standard packing machine for producing conventional rigid packets of cigarettes, in which the front and rear walls are larger than the lateral walls. Moreover, packing machine 1 as described above employs flat blanks 28, which are much cheaper and easier to process than flattened tubular blanks.

The invention claimed is:

1. A cigarette packing method for producing rigid, hinged-lid, short-hinge packets (30) of cigarettes;

each packet (30) of cigarettes comprises a wrapped group (13) of cigarettes and an outer package (31), which is formed by folding a flat blank (28), and which comprises a cup-shaped container (37) with an open top end (38), and a lid (39); the lid (39) is also cup-shaped, and is hinged to the container (37) along a hinge (40) to rotate, with respect to the container (37), between an open position and a closed position respectively opening and closing the open top end (38); when the lid (39) is in the closed position, the outer package (31) is parallelepiped-shaped, and comprises a vertical rear wall (41) in which the hinge (40) of the lid (39) is defined, a vertical front wall (42) opposite and parallel to the rear wall (41), two opposite parallel vertical lateral walls (43) larger than the front wall (42) and the rear wall (41), a horizontal bottom wall (44), and a horizontal top wall (45) opposite and parallel to the bottom wall (44); and each packet (30) of cigarettes comprises a collar (22) surrounding the wrapped group (13) of cigarettes inside the outer package (31), and projecting partly from the open top end (38) of the container (37) to engage an inner surface of the lid (39) when the lid (39) is in the closed position;

the packing method is characterized by comprising:

forming a line (4) of groups (5) of cigarettes;

receiving the groups (5) of cigarettes successively from the forming line (4) with a first transfer wheel (6);

receiving the groups (5) of cigarettes successively from the first transfer wheel (6) at a first transfer station (9) with a second transfer wheel (8), each group together with a respective sheet (11) of foil packing material, and folding the sheet (11) of packing material about the respective group (5) of cigarettes to form a wrapped group (13) of cigarettes;

receiving the wrapped groups (13) of cigarettes successively from the second packing wheel (8) at a second transfer station (17) with a third transfer wheel (15);

receiving the wrapped groups (13) of cigarettes from the third transfer wheel (15) at a third transfer station (18) with a fourth transfer wheel (19) and receiving the collars (22) from a first feed line (25) at an input station (21) located upstream from the third transfer station (18), and folding each collar (22) about a respective wrapped group (13) of cigarettes;

receiving at a fourth transfer station (24), each wrapped group (13) of cigarettes and the respective collar (22) together with a respective blank (28) supplied by a second feed line (29) with a fifth packing wheel (23), folding the blank (28) about the wrapped group (13) of cigarettes to form the outer package (31), and release the packets (30) of cigarettes at a fifth transfer station (32);

wherein at the input station (21), supplying the fourth packing wheel (19) by the first feed line (25) with a flat collar (22), folding the collar into a tube about the wrapped group (13) of cigarettes before being transferred, together with the wrapped group (13) of cigarettes, to the fifth packing wheel (23) at the fourth transfer station (24); and wherein each collar (22) comprises a rear wall (48) which is positioned contacting an inner surface of the rear wall (41) of the outer package (31); a front wall (49) which is positioned contacting an inner surface of the front wall (42) of the outer package (31); and two lateral walls (50) which are positioned contacting inner surfaces of the lateral walls (43) of the outer package (31);

at the input station (21), supplying each collar (22) flat to the fourth packing wheel (19), and the collar (22) remains flat up to the third transfer station (18), and inserting the wrapped group (13) of cigarettes into a seat on the fourth packing wheel (19) together with the collar (22),which folds into a U about the wrapped group (13) of cigarettes.

2. A packing method as claimed in claim 1, folding the collar (22) into a U about the wrapped group (13) of cigarettes by folding the rear wall (48) and the front wall (49) of the collar squarely with respect to a first lateral wall (50) of the collar; and, as the wrapped group (13) of cigarettes is fed from the third transfer station (18) to the fourth transfer station (24), a second lateral wall (50) of the collar (22) is folded 90° with respect to the front wall (49) of the collar and onto the wrapped group (13) of cigarettes to complete the folding of the collar (22) into a tube about the wrapped group (13) of cigarettes.

3. A packing method as claimed in claim 2, wherein the fourth packing wheel (19) comprises first fixed folding devices located between the third transfer station (18) and the fourth transfer station (24), and which fold the second lateral wall (50) of the collar (22) with respect to the front wall (49) of the collar.

4. A packing method as claimed in claim 1, wherein the blank (28) has two transverse fold lines (53), and a number of longitudinal fold lines (54) defining, between the two transverse fold lines (53), a first panel (41') forming an inner portion of the rear wall (41); a second panel (43') forming a first lateral wall (43); a third panel (42') forming the front wall (42); a fourth panel (43") forming a second lateral wall (43); and a fifth panel (41") forming an outer portion of the rear wall (41); the second panel (43') has two first tabs (44', 45'), which are located at opposite ends of the second panel (43'), are separated from the second panel (43') by the two transverse fold lines (53), and form outer portions of the bottom wall and top wall (44, 45) respectively; the fourth panel (43") has two second tabs (44", 45"), which are located at opposite ends of the fourth panel (43"), are separated from the fourth panel (43") by the two transverse fold lines (53), and form inner portions of the bottom wall and top wall (44, 45) respectively; the third panel (42') and the fifth panel (41") each have a third and a fourth tab (55, 56), which are located at opposite ends of the third panel (42') or the fifth panel (41"), are separated from the third panel (42') or the fifth panel (41") by the two transverse fold lines (53), and are glued to the inside of the bottom wall and top wall (44, 55) respectively; the first panel (41') and the fifth panel (41") have a first hinge fold line (40') and a second hinge fold line (40") respectively; a cut line (57) extends from the first hinge fold line (40') to the second hinge fold line (40") and across the second (43'), third (42') and fourth (43") panels to separate the part of the blank (28) forming the container (37) from the part forming the hinged lid (39);

at the fourth transfer station (24), a wrapped group (13) of cigarettes is inserted inside a seat on the fifth packing wheel (23) together with a blank (28), which folds into a U about the wrapped group (13) of cigarettes by folding the fifth panel (41") squarely with respect to the fourth panel (43"), and folding the third panel (42') squarely with respect to the fourth panel (43");

immediately downstream from the fourth transfer station (24), the second panel (43') is folded squarely with respect to the third panel (42') and onto the wrapped group (13) of cigarettes to complete the folding of the blank (28) into a tube about the wrapped group (13) of cigarettes;

subsequently, both the third tabs (55) are folded squarely with respect to the first panel (41') and the third panel (42') and onto the wrapped group (13) of cigarettes, and both the fourth tabs (56) are folded squarely with respect to the first panel (41') and the third panel (42') and onto the wrapped group (13) of cigarettes;

subsequently, the second tabs (44", 45") are folded squarely with respect to the fourth panel (43") and onto the wrapped group (13) of cigarettes and the previously folded third and fourth tabs (55, 56);

subsequently, the first tabs (44', 45') are folded squarely with respect to the second panel (43') and onto the wrapped group (13) of cigarettes and the previously folded second tabs (44", 45"); and finally, the first panel (41') is folded onto the wrapped group (13) of cigarettes and the previously folded fifth panel (41") at the fifth transfer station (32) as the packet (30) of cigarettes is expelled from the seat on the fifth packing wheel (23).

5. A packing method as claimed in claim 4 wherein the second feed line (29) comprises a gumming device to gum the inner surfaces of the fifth panel (41") and of the second tabs (44", 45"), and parts of the inner surfaces of the second, third, and fourth panel (43', 42', 43")corresponding to the collar (22).

6. A packing method as claimed in claim 1, wherein a sixth transfer wheel (33) receives the packets (30) of cigarettes from the fifth packing wheel (23) at the fifth transfer station (32).

7. A packing method as claimed in claim 1, wherein the fourth packing wheel (19) is horizontal and mounted to rotate in steps about a vertical first axis of rotation (20), and the fifth packing wheel (23) is vertical and mounted to rotate in steps about a horizontal second axis of rotation (27).

8. A packing method as claimed in claim 7, wherein the third transfer wheel (15) is horizontal and mounted to rotate in steps about a vertical third axis of rotation (16) parallel to the first axis of rotation (20) of the fourth packing wheel (19).

9. A packing method as claimed in claim 8, wherein, on the periphery of the third transfer wheel (15) and on the periphery of the fourth packing wheel (19), each wrapped group (13) of cigarettes is positioned on edge with its longitudinal axis crosswise to the first and third axis of rotation (20, 16) and substantially tangential with respect to the periphery of the relative third transfer wheel (15) and fourth packing wheel (19); the fourth packing wheel (19) and the third transfer wheel (15) overlap at the third transfer station (18), and the wrapped groups (13) of cigarettes are transferred from the third transfer wheel (15) to the fourth packing wheel (19) by a movement parallel to the first and third axis of rotation (20, 16).

10. A cigarette packing method for producing rigid, hinged-lid, short-hinge packets (30) of cigarettes;

each packet (30) of cigarettes comprises a wrapped group (13) of cigarettes and an outer package (31), which is formed by folding a flat blank (28), and which comprises a cup-shaped container (37) with an open top end (38), and a lid (39); the lid (39) is also cup-shaped, and is hinged to the container (37) along a hinge (40) to rotate, with respect to the container (37), between an open position and a closed position respectively opening and closing the open top end (38); when the lid (39) is in the closed position, the outer package (31) is parallelepiped-shaped, and comprises a vertical rear wall (41) in which the hinge (40) of the lid (39) is defined, a vertical front wall (42) opposite and parallel to the rear wall (41), two opposite parallel vertical lateral walls (43) larger than the front wall (42) and the rear wall (41), a horizontal bottom wall (44), and a horizontal top wall (45) opposite and parallel to the bottom wall (44); and each packet (30) of cigarettes comprises a collar (22) surrounding the wrapped group (13) of cigarettes inside the outer package (31), and projecting partly from the open top end (38) of the container (37) to engage an inner surface of the lid (39) when the lid (39) is in the closed position;

the packing method is characterized by comprising:

forming a line (4) of groups (5) of cigarettes;

receiving the groups (5) of cigarettes successively from the forming line (4) with a first transfer wheel (6);

receiving the groups (5) of cigarettes successively from the first transfer wheel (6) at a first transfer station (9) with a second transfer wheel (8), each group together with a respective sheet (11) of foil packing material, and folding the sheet (11) of packing material about the respective group (5) of cigarettes to form a wrapped group (13) of cigarettes;

receiving the wrapped groups (13) of cigarettes successively from the second packing wheel (8) at a second transfer station (17) with a third transfer wheel (15);

receiving the wrapped groups (13) of cigarettes from the third transfer wheel (15) at a third transfer station (18) with a fourth transfer wheel (19) and receiving the collars (22) from a first feed line (25) at an input station (21) located upstream from the third transfer station (18), and folding each collar (22) about a respective wrapped group (13) of cigarettes;

receiving at a fourth transfer station (24), each wrapped group (13) of cigarettes and the respective collar (22) together with a respective blank (28) supplied by a second feed line (29) with a fifth packing wheel (23), folding the blank (28) about the wrapped group (13) of cigarettes to form the outer package (31), and release the packets (30) of cigarettes at a fifth transfer station (32);

wherein at the input station (21), supplying the fourth packing wheel (19) by the first feed line (25) with a flat collar (22), folding the collar into a tube about the wrapped group (13) of cigarettes before being transferred, together with the wrapped group (13) of cigarettes, to the fifth packing wheel (23) at the fourth transfer station (24); and wherein each collar (22) comprises a rear wall (48) which is positioned contacting an inner surface of the rear wall (41) of the outer package (31); a front wall (49) which is positioned contacting an inner surface of the front wall (42) of the outer package (31); and two lateral walls (50) which are positioned contacting inner surfaces of the lateral walls (43) of the outer package (31);

supplying at the input station (21), each collar (22) flat to the fourth packing wheel (19), and is immediately folded into a U by insertion of the collar (22) inside a seat on the fourth packing wheel (19).

11. A packing method as claimed in claim 10, wherein the blank (28) has two transverse fold lines (53), and a number of longitudinal fold lines (54) defining, between the two transverse fold lines (53), a first panel (41') forming an inner portion of the rear wall (41); a second panel (43') forming a first lateral wall (43); a third panel (42') forming the front wall (42); a fourth panel (43") forming a second lateral wall (43); and a fifth panel (41") forming an outer portion of the rear wall (41); the second panel (43') has two first tabs (44', 45'), which are located at opposite ends of the second panel (43'), are separated from the second panel (43') by the two transverse fold lines (53), and form outer portions of the bottom wall and top wall (44, 45) respectively; the fourth panel (43") has two second tabs (44", 45"), which are located at opposite ends of the fourth panel (43"), are separated from the fourth panel (43") by the two transverse fold lines (53), and form inner portions of the bottom wall and top wall (44, 45) respectively; the third panel (42') and the fifth panel (41") each have a third and a fourth tab (55, 56), which are located at opposite ends of the third panel (42') or the fifth panel (41"), are separated from the third panel (42') or the fifth panel (41") by the two transverse fold lines (53), and are glued to the inside of the bottom wall and top wall (44, 55) respectively; the first panel (41') and the fifth panel (41") have a first hinge fold line (40') and a second hinge fold line (40") respectively; a cut line (57) extends from the first hinge fold line (40') to the second hinge fold line (40") and across the second (43'), third (42') and fourth (43") panels to separate the part of the blank (28) forming the container (37) from the part forming the hinged lid (39);

at the fourth transfer station (24), a wrapped group (13) of cigarettes is inserted inside a seat on the fifth packing wheel (23) together with a blank (28), which folds into a U about the wrapped group (13) of cigarettes by folding the fifth panel (41") squarely with respect to the fourth panel (43"), and folding the third panel (42') squarely with respect to the fourth panel (43");

immediately downstream from the fourth transfer station (24), the second panel (43') is folded squarely with respect to the third panel (42') and onto the wrapped group (13) of cigarettes to complete the folding of the blank (28) into a tube about the wrapped group (13) of cigarettes; subsequently, both the third tabs (55) are folded squarely with respect to the first panel (41') and the third panel (42') and onto the wrapped group (13) of cigarettes, and both the fourth tabs (56) are folded squarely with respect to the first panel (41') and the third panel (42') and onto the wrapped group (13) of cigarettes;

subsequently, the second tabs (44", 45") are folded squarely with respect to the fourth panel (43") and onto the wrapped group (13) of cigarettes and the previously folded third and fourth tabs (55, 56);

subsequently, the first tabs (44', 45') are folded squarely with respect to the second panel (43') and onto the wrapped group (13) of cigarettes and the previously folded second tabs (44", 45");

and finally, the first panel (41') is folded onto the wrapped group (13) of cigarettes and the previously folded fifth panel (41") at the fifth transfer station (32) as the packet (30) of cigarettes is expelled from the seat on the fifth packing wheel (23).

12. A packing method as claimed in claim 11 wherein the second feed line (29) comprises a gumming device to gum the inner surfaces of the fifth panel (41") and of the second tabs (44", 45"), and parts of the inner surfaces of the second, third, and fourth panel (43', 42', 43") corresponding to the collar (22).

13. A packing method as claimed in claim 10, wherein a sixth transfer wheel (33) receives the packets (30) of cigarettes from the fifth packing wheel (23) at the fifth transfer station (32).

14. A packing method as claimed in claim 10, wherein the fourth packing wheel (19) is horizontal and mounted to rotate in steps about a vertical first axis of rotation (20), and the fifth packing wheel (23) is vertical and mounted to rotate in steps about a horizontal second axis of rotation (27).

15. A packing method as claimed in claim 14, wherein the third transfer wheel (15) is horizontal and mounted to rotate in steps about a vertical third axis of rotation (16) parallel to the first axis of rotation (20) of the fourth packing wheel (19).

16. A packing method as claimed in claim 15, wherein, on the periphery of the third transfer wheel (15) and on the periphery of the fourth packing wheel (19), each wrapped group (13) of cigarettes is positioned on edge with its longitudinal axis crosswise to the first and third axis of rotation (20, 16) and substantially tangential with respect to the periphery of the relative third transfer wheel (15) and fourth packing wheel (19); the fourth packing wheel (19) and the third transfer wheel (15) overlap at the third transfer station (18), and the wrapped groups (13) of cigarettes are transferred from the third transfer wheel (15) to the fourth packing wheel (19) by a movement parallel to the first and third axis of rotation (20, 16).

* * * * *